US009984623B2

(12) United States Patent
An et al.

(10) Patent No.: US 9,984,623 B2
(45) Date of Patent: May 29, 2018

(54) PIXEL AND ORGANIC LIGHT EMITTING DISPLAY DEVICE HAVING THE SAME

(71) Applicant: Samsung Display Co., Ltd., Yongin-si, Gyeonggi-Do (KR)

(72) Inventors: Tae-Hyeong An, Hwaseong-si (KR); Ja-Kyoung Jin, Hwaseong-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 201 days.

(21) Appl. No.: 15/149,757

(22) Filed: May 9, 2016

(65) Prior Publication Data

US 2017/0092191 A1 Mar. 30, 2017

(30) Foreign Application Priority Data

Sep. 24, 2015 (KR) ..... 10-2015-0135538

(51) Int. Cl.
*G09G 5/10* (2006.01)
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0842* (2013.01); *G09G 2300/0861* (2013.01); *G09G 2310/0262* (2013.01); *G09G 2310/08* (2013.01); *G09G 2320/0247* (2013.01); *G09G 2330/021* (2013.01); *G09G 2340/0435* (2013.01)

(58) Field of Classification Search
CPC ..... G09G 3/3233; G09G 3/3275; G09G 2300/0842; G09G 2300/0861; G09G 2310/0262; G09G 2310/08; G09G 2320/0247; G09G 2320/021; G09G 2340/0435
See application file for complete search history.

(56) References Cited

U.S. PATENT DOCUMENTS

2016/0140900 A1* 5/2016 Yang ..... G09G 3/3258 345/206
2017/0193923 A1* 7/2017 Park ..... G09G 3/3258

FOREIGN PATENT DOCUMENTS

KR 10-2014-0077452 A 6/2014

* cited by examiner

*Primary Examiner* — Peter D McLoone
(74) *Attorney, Agent, or Firm* — Innovation Counsel, LLP

(57) ABSTRACT

An organic light emitting display device includes a display panel including and a plurality of pixels, a gate driver configured to a normal gate signal and an alternative gate signal to the pixels, a data driver configured to provide a data signal to the pixels, an emission control driver configured to an emission control signal to the pixels, and a controller configured to control the gate driver, the data driver, and the emission control driver. Each of the pixels is driven by the normal gate signal in a first driving mode and is driven by the alternative gate signal in a second driving mode. A threshold voltage of a first transistor is compensated in the first driving mode and the threshold voltage of the first transistor is not compensated in the second driving mode.

20 Claims, 11 Drawing Sheets

PIXEL AND ORGANIC LIGHT EMITTING DISPLAY DEVICE HAVING THE SAME

CROSS REFERENCE TO RELATED APPLICATION

This application claims priority under 35 U.S.C. § 119 to Korean patent Application No. 10-2015-0135538 filed on Sep. 24, 2015, the disclosure of which is hereby incorporated by reference herein in its entirety.

BACKGROUND

1. Technical Field

Example embodiments of the inventive concept relate to display devices. More particularly, example embodiments of the inventive concept relate to a pixel and an organic light emitting display device having the pixel.

2. Description of the Related Art

An organic light emitting diode (OLED) includes an organic layer between two electrodes, namely, an anode and a cathode. Positive holes from the anode are combined with electrons from the cathode in the organic layer between the anode and the cathode to emit light. The OLED has a variety of advantages such as a wide viewing angle, a rapid response speed, relatively thin thickness, and low power consumption.

An organic light emitting display device performs operations for compensating a threshold voltage of a driving transistor within a pixel such as an initialization operation, a data writing operation, and a threshold voltage compensating operation. Here, the emission off-period of the pixel is set by controlling an emission control signal not to display an undesired image. However, when the organic light emitting display device is driven in a relatively low frequency to reduce the power consumption, a flicker can occur by the emission off-period.

SUMMARY

Example embodiments provide an organic light emitting display device capable of improving a flicker.

Example embodiments provide a pixel for the organic light emitting display device.

According to some example embodiments, an organic light emitting display device may include a display panel including and a plurality of pixels, a gate driver configured to provide a normal gate signal and an alternative gate signal to the pixels, a data driver configured to provide a data signal to the pixels, an emission control driver configured to provide an emission control signal to the pixels, and a controller configured to control the gate driver, the data driver, and the emission control driver. Each of the pixels may be driven by the normal gate signal in a first driving mode in which a threshold voltage of a first transistor is compensated and is driven by the alternative gate signal in a second driving mode in which the threshold voltage of the first transistor is not compensated.

In example embodiments, each of the pixels may include an organic light emitting diode, a first transistor including a first electrode connected to a first node, a second node connected to a second node, and a gate electrode connected to a third node, a second transistor including a first electrode receiving the data signal, a second electrode connected to the first node, and a gate electrode receiving the normal gate signal, a third transistor including a first electrode connected to the second node, a second electrode connected to the third node, and a gate electrode receiving the normal gate signal, a fourth transistor including a first electrode connected to a first power source, a second electrode connected to the first node, and a gate electrode receiving the emission control signal, a fifth transistor including a first electrode connected to the second node, a second electrode connected to a first electrode of the organic light emitting diode, and a gate electrode receiving the emission control signal, a sixth transistor including a first electrode receiving the data signal, a second electrode connected to the third node, and a gate electrode receiving the alternative gate signal, and a capacitor including a first electrode connected to the third node and a second electrode connected to the first power source.

In example embodiments, each of the pixels further may include a seventh transistor including a first electrode connected to an initialization power source, a second electrode connected to the third node, and a gate electrode receiving a first initialization gate signal.

In example embodiments, each of the pixels may further include an eighth transistor including a first electrode connected to the initialization power source, a second electrode connected to the first electrode of the organic light emitting diode, and a gate electrode receiving a second initialization gate signal.

In example embodiments, the first initialization gate signal may be substantially the same as the second initialization gate signal. The normal gate signal and the first initialization gate signal may be applied to each of the pixels with an interval of one horizontal period.

In example embodiments, the controller may include an image data analyzer configured to derive at least one selected from a grayscale distribution of image data, a first difference value between image data of a current frame and image data of a previous frame, and a second difference value between image data of adjacent pixels, a driving determiner configured to determine a panel driving mode and a driving frequency based on at least one selected from the grayscale distribution, the first difference value, and the second difference value, and a control signal controller configured to generate a control signal for controlling the gate driver, the data driver, and the emission control driver based on the panel driving mode and the driving frequency.

In example embodiments, the driving determiner may include a driving mode selector configured to select the first driving mode or the second driving mode as the panel driving mode based on at least one selected from the grayscale distribution, the first difference value, and the second difference value, and a driving frequency determiner configured to determine the driving frequency based on at least one selected from the grayscale distribution, the first difference value, and the second difference value.

In example embodiments, the driving mode selector may derive a first number of pixels each of which grayscale is higher than or equal to a reference grayscale from the grayscale distribution, selects the first driving mode as the panel driving mode when the first number is lower than a first reference value, and selects the second driving mode as the panel driving mode when the first number is higher than or equal to the first reference value.

In example embodiments, the driving frequency determiner may derive a first number of pixels each of which grayscale is higher than or equal to a reference grayscale from the grayscale distribution, set the driving frequency to a first frequency when the first number is lower than a first reference value, and set the driving frequency to a second frequency lower than the first frequency when the first number is higher than or equal to the first reference value.

In example embodiments, the driving mode selector may select the first driving mode as the panel driving mode when the first difference is higher than or equal to a second reference value and selects the second driving mode as the panel driving mode when the first difference is lower than the second reference value.

In example embodiments, the driving frequency determiner may set the driving frequency to a first frequency when the first difference is higher than or equal to a second reference value and set the driving frequency to a second frequency lower than the first frequency when the first difference is lower than the second reference value.

In example embodiments, the driving mode selector may select the first driving mode as the panel driving mode when the second difference is lower than a third reference value and selects the second driving mode as the panel driving mode when the second difference is higher than or equal to the third reference value.

In example embodiments, the driving frequency determiner may set the driving frequency to a first frequency when the second difference is lower than a third reference value and set the driving frequency to a second frequency lower than the first frequency when the second difference is higher than or equal to the third reference value.

In example embodiments, the driving determiner may further include an emission controller configured to adjust a length of an off-period of the emission control signal based on at least one selected from the grayscale distribution, the first difference value, and the second difference value.

In example embodiments, the control signal generator may generate the control signal such that the normal gate signal is sequentially outputted to a plurality of normal gate lines when the panel driving mode is the first driving mode, and generate the control signal such that the alternative gate signal is sequentially outputted to a plurality of alternative gate lines when the panel driving mode is the second driving mode.

In example embodiments, the control signal generator may generate the control signal such that the emission control signal is an off-level in at least a portion of the first driving mode, and generate the control signal such that the emission control signal maintains an on-level during the second driving mode.

According to some example embodiments, a pixel may include an organic light emitting diode, a first transistor including a first electrode connected to a first node, a second node connected to a second node, and a gate electrode connected to a third node, a second transistor including a first electrode receiving a data signal, a second electrode connected to the first node, and a gate electrode receiving a normal gate signal, a third transistor including a first electrode connected to the second node, a second electrode connected to the third node, and a gate electrode receiving the normal gate signal, a fourth transistor including a first electrode connected to a first power source, a second electrode connected to the first node, and a gate electrode receiving an emission control signal, a fifth transistor including a first electrode connected to the second node, a second electrode connected to a first electrode of the organic light emitting diode, and a gate electrode receiving the emission control signal, a sixth transistor including a first electrode receiving the data signal, a second electrode connected to the third node, and a gate electrode receiving an alternative gate signal, and a capacitor including a first electrode connected to the third node and a second electrode connected to the first power source.

In example embodiments, the pixel may further include a seventh transistor including a first electrode connected to an initialization power source, a second electrode connected to the third node, and a gate electrode receiving a first initialization gate signal.

In example embodiments, the pixel may further include an eighth transistor including a first electrode connected to the initialization power source, a second electrode connected to the first electrode of the organic light emitting diode, and a gate electrode receiving a second initialization gate signal.

In example embodiments, the first initialization gate signal may be substantially the same as the second initialization gate signal. The normal gate signal and the first initialization gate signal may be applied with an interval of one horizontal period.

Therefore, a pixel according to example embodiments includes 8 transistors and 1 capacitor and is driven in a first driving mode or a second driving mode. A threshold voltage of a driving transistor is compensated in the first driving mode. The threshold voltage of the driving transistor is not compensated and the pixel is driven without the emission off-period in the second driving mode.

An organic light emitting display device including the pixel determines a panel driving mode and a driving frequency based on image data. Accordingly, when the organic light emitting display device drives the display panel in a low frequency driving mode for reducing power consumption, the flicker does not recognized by user.

BRIEF DESCRIPTION OF THE DRAWINGS

Exemplary embodiments will be described more fully hereinafter with reference to the accompanying drawings, in which various embodiments are shown.

DESCRIPTION OF EMBODIMENTS

Exemplary embodiments will be described more fully hereinafter with reference to the accompanying drawings, in which various embodiments are shown.

Figure 1:
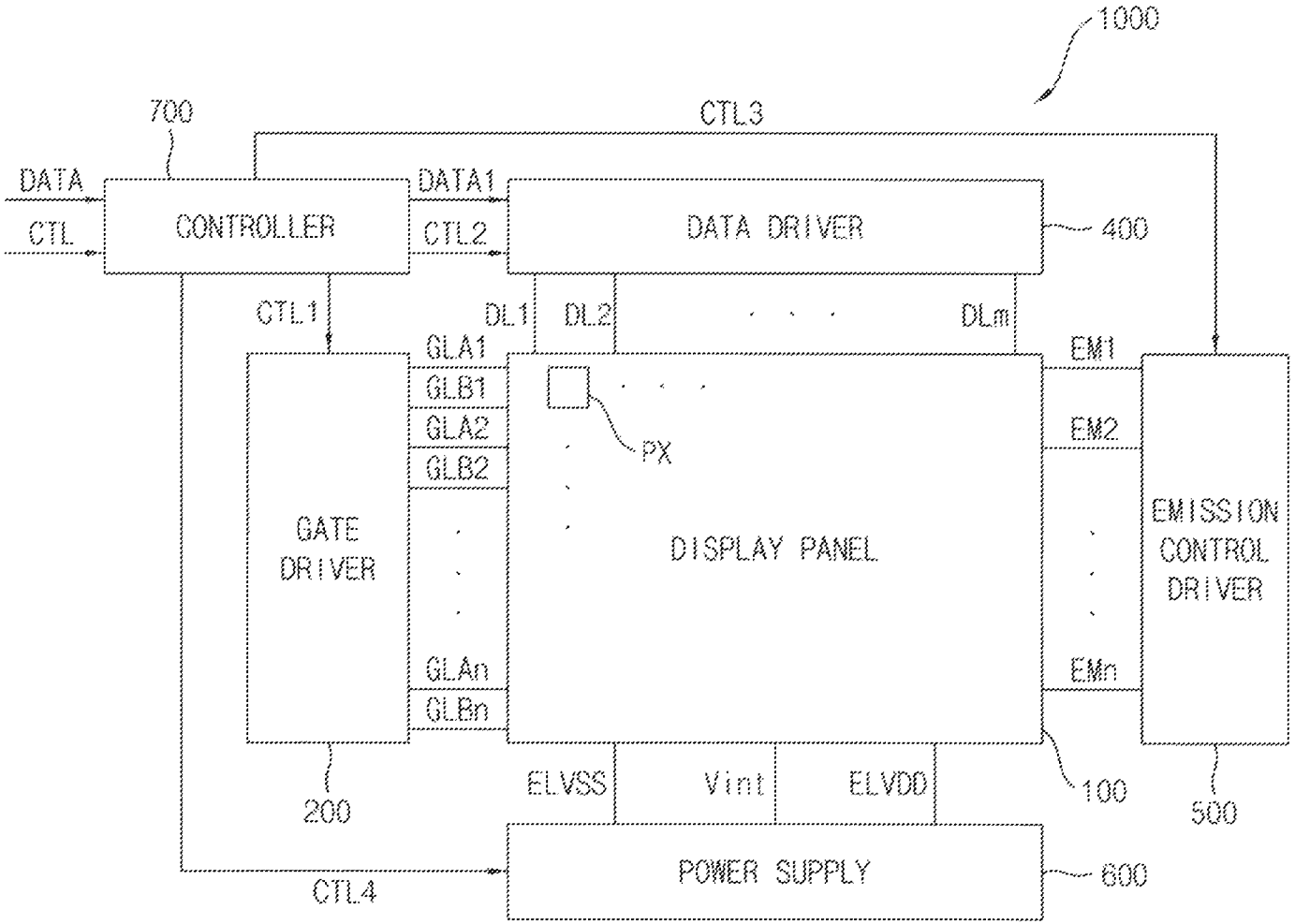
FIG. 1 is a block diagram illustrating an organic light emitting display device according to one example embodiment.

FIG. 1 is a block diagram illustrating an organic light emitting display device according to one example embodiment.

Referring FIG. 1, the organic light emitting display device 1000 may include a display panel 100, a gate driver 200, a data driver 400, an emission control driver 500, a power supply 600, and a controller 700.

The display panel 100 may display an image. The display panel 100 may include a plurality of pixels PX. For example, the display panel 100 may include n*m pixels PX because the pixels PX are arranged at locations corresponding to crossing points of the normal gate lines GLA1 through GLAn and the data lines DL1 through DLm. Each of the pixels PX may be driven by a normal gate signal in a first driving mode and may be driven by an alternative gate signal in a second driving mode. A threshold voltage of a first transistor (i.e., a driving transistor) may be compensated in the first driving mode and the threshold voltage of the first transistor may be not compensated in the second driving mode. For example, the pixel PX may be driven in the first driving mode including an initialization period, a data writing period, a threshold voltage compensating period, and an emission period to compensate the threshold voltage of the driving transistor. Also, the pixel PX may be driven in the second driving mode without the emission off-period in which the OLED does not emit the light. Hereinafter, a structure of the pixel PX will be described in more detail with reference to the FIG. 2.

The gate driver 200 may provide the normal gate signal to the pixels PX via the normal gate lines GLA1 through GLAn and provide the alternative gate signal to the pixels PX via the alternative gate lines GLB1 through GLBn in respond to a first control signal CTL1. In one example embodiment, the gate driver 200 may include a plurality of normal stages sequentially outputting the normal gate signal to the normal gate lines GLA1 through GLAn in the first driving mode and a plurality of alternative stages sequentially outputting the alternative gate signal to the alternative gate lines GLB1 through GLBn in the second driving mode.

The data driver 400 may provide a data signal to the pixels PX via the data lines DL1 through DLm in respond to a second control signal CTL2.

The emission control driver 500 may provide an emission control signal to the pixels PX via the emission control lines EM1 through EMn in respond to a third control signal CTL3. In one example embodiment, the emission control driver 500 may include a plurality of emission control stages sequentially outputting the emission control signal to the emission control lines EM1 through EMn in the first driving mode.

The power supply 600 may provide a first power source ELVDD, a second power source ELVSS, and an initialization power source Vint to the pixel PX.

The controller 700 may control the gate driver 200, the data driver 300, the emission control driver 500, and the power supply 600. The controller 700 may derive at least one of a grayscale distribution of image data, a first difference value between image data of a current frame and image data of a previous frame, and a second difference value between image data of adjacent pixels from input image data DATA. The controller 700 may determine a panel driving mode and a driving frequency based on at least one of the grayscale distribution, the first difference value, and the second difference value. The controller 700 may generate control signals CTL1 through CTL4 for controlling the gate driver 200, the data driver 400, the emission control driver 500, and the power supply 600, respectively, based on the panel driving mode and the driving frequency. Hereinafter, a structure of the controller 700 will be described in more detail with reference to the FIG. 3.

Figure 2:
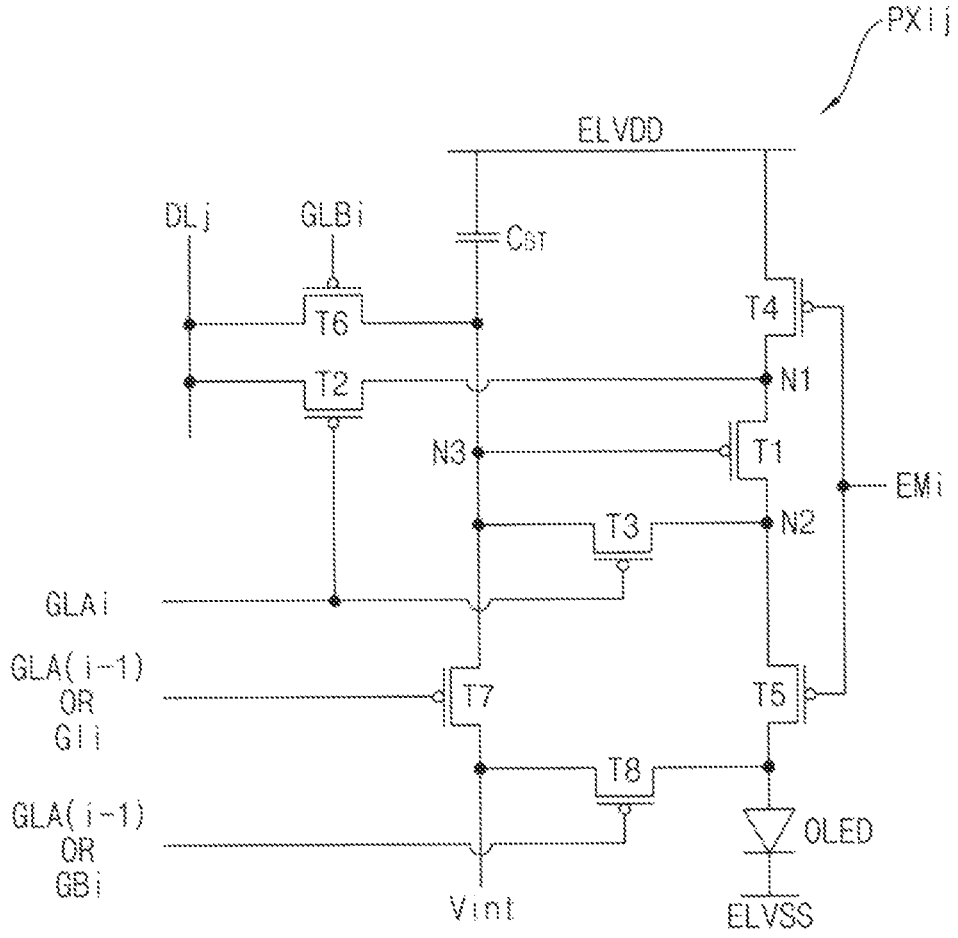
FIG. 2 is a circuit diagram illustrating an example of a pixel included in an organic light emitting display device of FIG. 1.

FIG. 2 is a circuit diagram illustrating an example of a pixel included in an organic light emitting display device of FIG. 1.

Referring FIG. 2, the pixel PXij may include an organic light emitting diode OLED, first through eight transistors T1 through T8, and a capacitor Cst.

The first transistor T1 may include a first electrode connected to a first node N1, a second node connected to a second node N2, and a gate electrode connected to a third node N3. The first transistor T1 may be a driving transistor.

The second transistor T2 may include a first electrode receiving the data signal, a second electrode connected to the first node N1, and a gate electrode receiving the normal gate signal.

The third transistor T3 may include a first electrode connected to the second node N2, a second electrode connected to the third node N3, and a gate electrode receiving the normal gate signal.

The fourth transistor T4 may include a first electrode connected to a first power source ELVDD, a second electrode connected to the first node N1, and a gate electrode receiving the emission control signal.

The fifth transistor T5 may include a first electrode connected to the second node N2, a second electrode connected to a first electrode of the organic light emitting diode OLED, and a gate electrode receiving the emission control signal.

The sixth transistor T6 may include a first electrode receiving the data signal, a second electrode connected to the third node N3, and a gate electrode receiving the alternative gate signal.

The seventh transistor T7 may include a first electrode connected to an initialization power source Vint, a second electrode connected to the third node N3, and a gate electrode receiving a first initialization gate signal from the (i−1)th normal gate line GLA(i−1) or the (i)th data initialization gate line GI(i).

The eighth transistor T8 may include a first electrode connected to the initialization power source Vint, a second electrode connected to the first electrode of the organic light emitting diode OLED, and a gate electrode receiving a second initialization gate signal from the (i−1)th normal gate line GLA(i−1) or the (i)th diode initialization gate line GB(i). In one example embodiment, the first initialization gate signal may be substantially the same as the second initialization gate signal, and the normal gate signal and the first initialization gate signal may be applied to each of the pixels with an interval of one horizontal period. For example, the gate electrode of the second transistor T2 and the gate electrode of the third transistor T3 may be connected to the (i)th normal gate line GLAi, and the gate electrode of the seventh transistor T7 and the gate electrode of eighth transistor T8 may be connected to the (i−1)th normal gate line GLA(i−1), where i is an integer greater than 1, and lesser than or equal to n.

A capacitor Cst may include a first electrode connected to the third node T3 and a second electrode connected to the first power source ELVDD.

Therefore, when the normal gate signal is applied to the second and third transistors T2 and T3 and the alternative gate signal is not applied to the sixth transistor T6, the pixel PXij may be driven in the first driving mode including an initialization period, a data writing period, a threshold voltage compensating period, and an emission period to compensate a threshold voltage of the driving transistor.

Hereinafter, a method of driving the pixel PXij in the first driving mode will be described in more detail with reference to the FIGS. 5 and 6.

On the other hand, when the alternative gate signal is applied to the sixth transistor T6 and the normal gate signal is applied to the second and third transistors T2 and T3, the pixel PXij may be driven in the second driving mode in which a threshold voltage of the driving transistor may is not compensated and the pixels are driven without the emission off-period. Hereinafter, a method of driving the pixel PXij in the second driving mode will be described in more detail with reference to the FIGS. 8 and 9.

Figure 3:
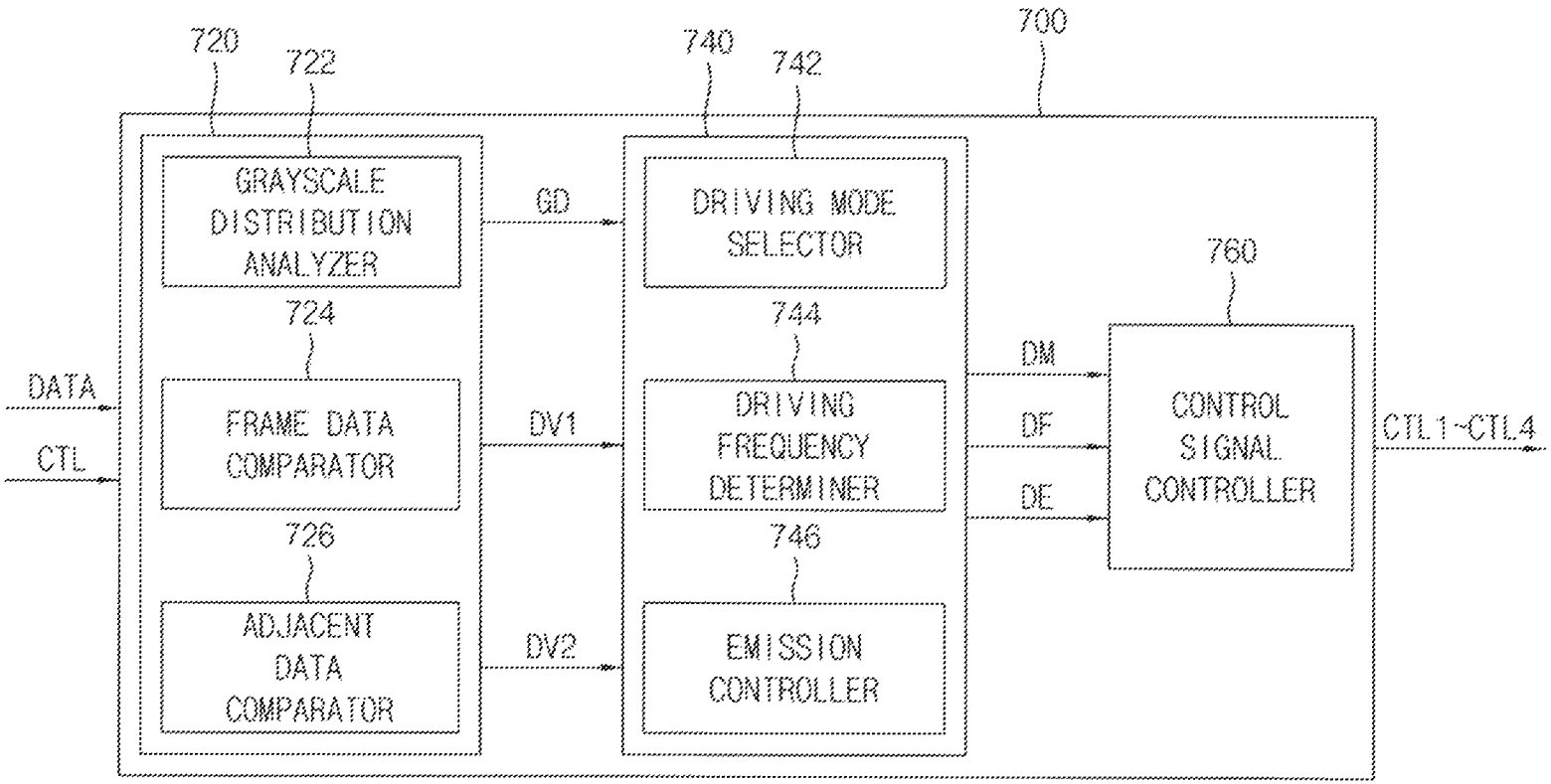
FIG. 3 is a block diagram illustrating an example of a controller included in an organic light emitting display device of FIG. 1.

FIG. 3 is a block diagram illustrating an example of a controller included in an organic light emitting display device of FIG. 1.

Referring FIG. 3, the controller 700 may include an image data analyzer 720, a driving determiner 740, and a control signal generator 760.

The image data analyzer 720 may derive at least one of a grayscale distribution GD of image data, a first difference value DV1 between image data of a current frame and image data of a previous frame, and a second difference value DV2 between image data of adjacent pixels from input image data DATA. In one example embodiment, the image data analyzer 720 may include a grayscale distribution analyzer 722, a frame data comparator 724, and an adjacent data comparator 726.

The grayscale distribution analyzer 722 may derive the grayscale distribution GD of image data from the input image data DATA. For example, the grayscale distribution analyzer 722 may drive the number of pixels corresponding to each grayscale (i.e., histogram) from the input image data DATA.

The frame data comparator 724 may derive the first difference value DV1 by comparing the image data of current frame with the image data of previous frame. For example, the first difference value DV1 may be set to a sum of difference values between the image data of current frame and the image data of previous frame. The first difference value DV1 indicates an amount of change of image data between the current frame and the previous frame. The first difference value DV1 may determine whether the image data correspond to still image data or moving image data.

The adjacent data comparator 726 may derive the second difference value DV2 by comparing image data of adjacent pixels that are adjacent to each other in all directions or in one direction. For example, the second difference value DV2 may be set to a sum of difference values between grayscales of adjacent pixels in a same frame. The second difference value DV2 indicates a dispersion degree of pixels having similar grayscales to each other.

The driving determiner 740 may determine a panel driving mode DM, a driving frequency DF, and a length of an off-period of the emission control signal DE based on at least one of the grayscale distribution GD, the first difference value DV1, and the second difference value DV2. In one example embodiment, the driving determiner 740 may include a driving mode selector 742, a driving frequency determiner 744, and an emission controller 746.

The driving mode selector 742 may select the first driving mode or the second driving mode as the panel driving mode DM based on at least one of the grayscale distribution GD, the first difference value DV1, and the second difference value DV2.

In one example embodiment, the driving mode selector 742 may derive a first number of pixels each of which grayscale is greater than or equal to a reference grayscale (i.e., the number of high grayscale pixels) by analyzing the grayscale distribution GD, select the first driving mode as the panel driving mode DM when the first number is lesser than a first reference value, and select the second driving mode as the panel driving mode DM when the first number is greater than or equal to the first reference value. For example, when a proportion of the number of high grayscale pixels is relatively low, the display quality can be decreased because the deviation of the threshold voltage of the driving transistor is remarkably recognized in a low grayscale region. In this case, the driving mode selector 742 may select the first driving mode in which the threshold voltage of the driving transistor is compensated as the panel driving mode DM. On the other hand, when a proportion of the number of high grayscale pixels is relatively high, a flicker can occur by the emission off-period of the pixels. In this case, the driving mode selector 742 may select the second driving mode in which the threshold voltage of the driving transistor is not compensated and the pixels are driven without the emission off-period.

In one example embodiment, the driving mode selector 742 may select the first driving mode as the panel driving mode DM when the first difference DV1 is greater than or equal to a second reference value and select the second driving mode as the panel driving mode DM when the first difference DV1 is lesser than the second reference value. When the amount of change of image data between the current frame and the previous frame is relatively large (e.g., a moving picture image), the driving mode selector 742 may select the first driving mode as the panel driving mode DM to prevent the degradation of the display quality that occurs by the deviation of the threshold voltage of the driving transistor. On the other hand, when the amount of change of image data between the current frame and the previous frame is relatively small (e.g., a still image), the driving mode selector 742 may select the second driving mode as the panel driving mode DM to prevent the flicker that occurs by the emission off-period when the pixel is driven with low frequency.

In one example embodiment, the driving mode selector 742 may select the first driving mode as the panel driving mode DM when the second difference DV2 is lesser than a third reference value and select the second driving mode as the panel driving mode DM when the second difference DV2 is greater than or equal to the third reference value. When the dispersion degree of pixels having grayscales similar to each other is relatively small, the driving mode selector 742 may select the first driving mode as the panel driving mode DM to prevent the degradation of the display quality that occurs by the deviation of grayscale in adjacent pixels. On the other hand, when the dispersion degree of pixels having grayscales similar to each other is relatively large, the driving mode selector 742 may select the second driving mode as the panel driving mode DM to prevent the flicker that occurs by the emission off-period when the pixel is driven with low frequency.

The driving frequency determiner 744 may determine the driving frequency DF based on at least one of the grayscale distribution GD, the first difference value DV1, and the second difference value DV2.

In one example embodiment, the driving frequency determiner 744 may derive a first number of pixels each of which grayscale is greater than or equal to a reference grayscale (i.e., the number of high grayscale pixels) by analyzing the grayscale distribution GD, set the driving frequency DF to a first frequency when the first number of pixels is lesser than a first reference value, and set the driving frequency DF to a second frequency lesser than the first frequency when the first number of pixels is greater than or equal to the first reference value. For example, when a proportion of the number of high grayscale pixels is relatively low, the driving frequency determiner 744 may set the driving frequency DF to the first frequency that is relatively high to prevent the degradation of the display quality. On the other hand, when a proportion of the number of high grayscale pixels is relatively high, the driving frequency determiner 744 may set the driving frequency DF to the second frequency that is relatively low to reduce the power consumption.

In one example embodiment, the driving frequency determiner 744 may set the driving frequency DF to the first frequency when the first difference DV1 is greater than or equal to a second reference value and set the driving frequency DF to the second frequency lesser than the first frequency when the first difference DV1 is lesser than the second reference value. When the amount of change of image data between the current frame and the previous frame is relatively large (e.g., a moving image), the driving frequency determiner 744 may set the driving frequency DF to the first frequency that is relatively high to prevent the degradation of the display quality. On the other hand, when the amount of change of image data between the current frame and the previous frame is relatively small (e.g., a still image), the driving frequency determiner 744 may set the driving frequency DF to the second frequency that is relatively low to reduce the power consumption.

In one example embodiment, the driving frequency determiner 744 may set the driving frequency DF to the first frequency when the second difference DV2 is lesser than a third reference value and set the driving frequency DF to the second frequency lesser than the first frequency when the second difference DV2 is greater than or equal to the third reference value. For example, when the dispersion degree of pixels having grayscales similar to each other is relatively small, the driving frequency determiner 744 may set the driving frequency DF to the first frequency that is relatively high to prevent the degradation of the display quality. On the other hand, when the dispersion degree of pixels having grayscales similar to each other is relatively large, the driving frequency determiner 744 may set the driving frequency DF to the second frequency that is relatively low to reduce the power consumption.

The emission controller 746 may adjust a length DE of an off-period of the emission control signal based on at least one of the grayscale distribution GD, the first difference value DV1, and the second difference value DV2. For example, to prevent the flicker that occurs by the emission off-period when the pixel is driven with low frequency, the emission controller 746 may set the length DE of the off-period of the emission control signal to be shortened.

The control signal generator 760 may generate control signals CTL1 through CTL4 for controlling the gate driver, the data driver, and the emission control driver based on the panel driving mode DM and the driving frequency DF. In one example embodiment, the control signal generator 760 may generate the control signals such that the normal gate signal is sequentially outputted to a plurality of normal gate lines when the panel driving mode DM is the first driving mode, and generate the control signals such that the alternative gate signal is sequentially outputted to a plurality of alternative gate lines when the panel driving mode DM is the second driving mode. In one example embodiment, the control signal generator 760 may generate the control signals such that the emission control signal is an off-level in at least a portion of the first driving mode and generate the control signals such that the emission control signal maintains an on-level during the second driving mode.

Figure 4A:
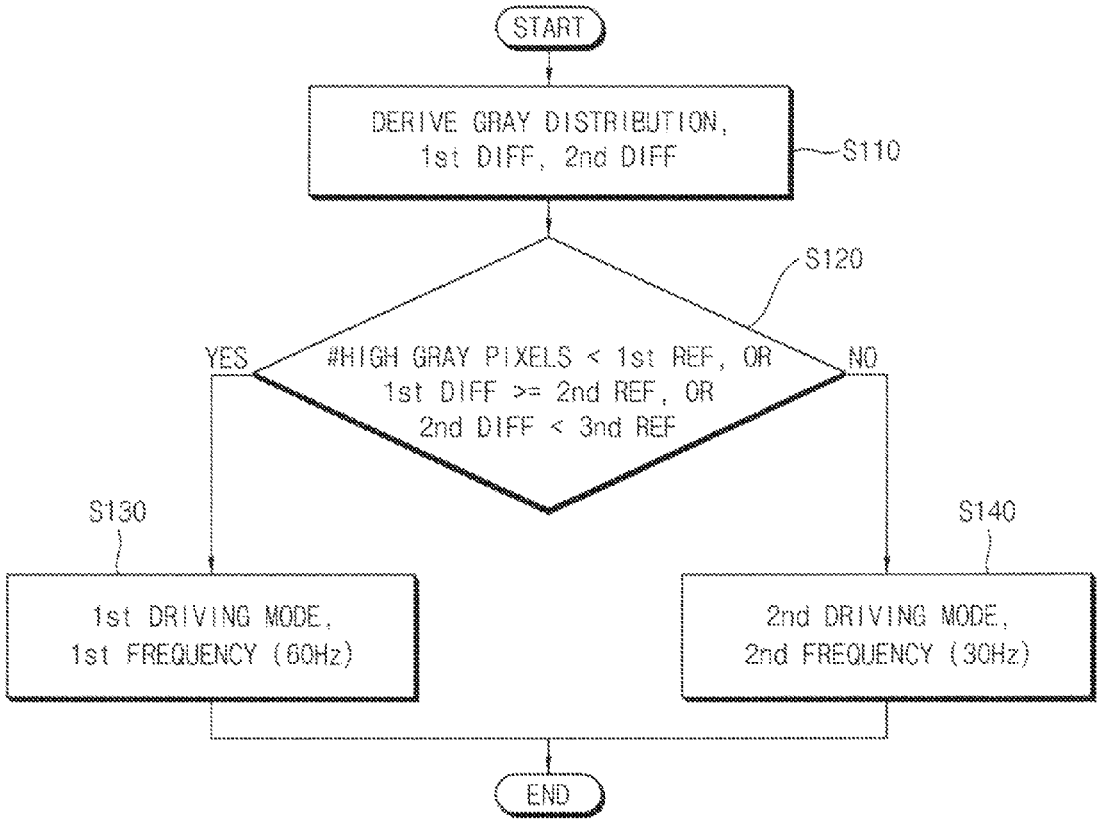
FIGS. 4A, 4B and 4C are flow charts illustrating methods of determining a panel driving mode and a driving frequency by a controller of FIG. 3.
Figure 4B:
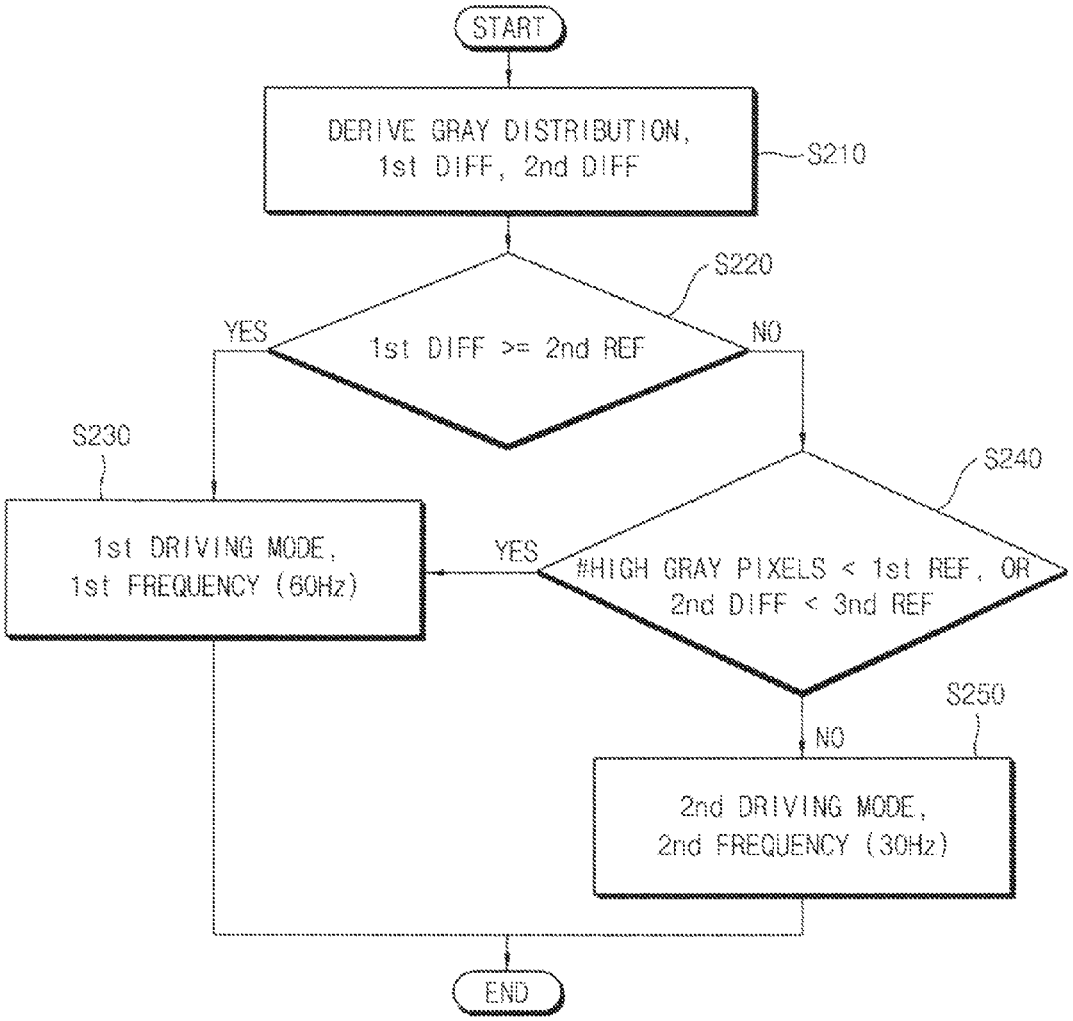
Figure 4C:
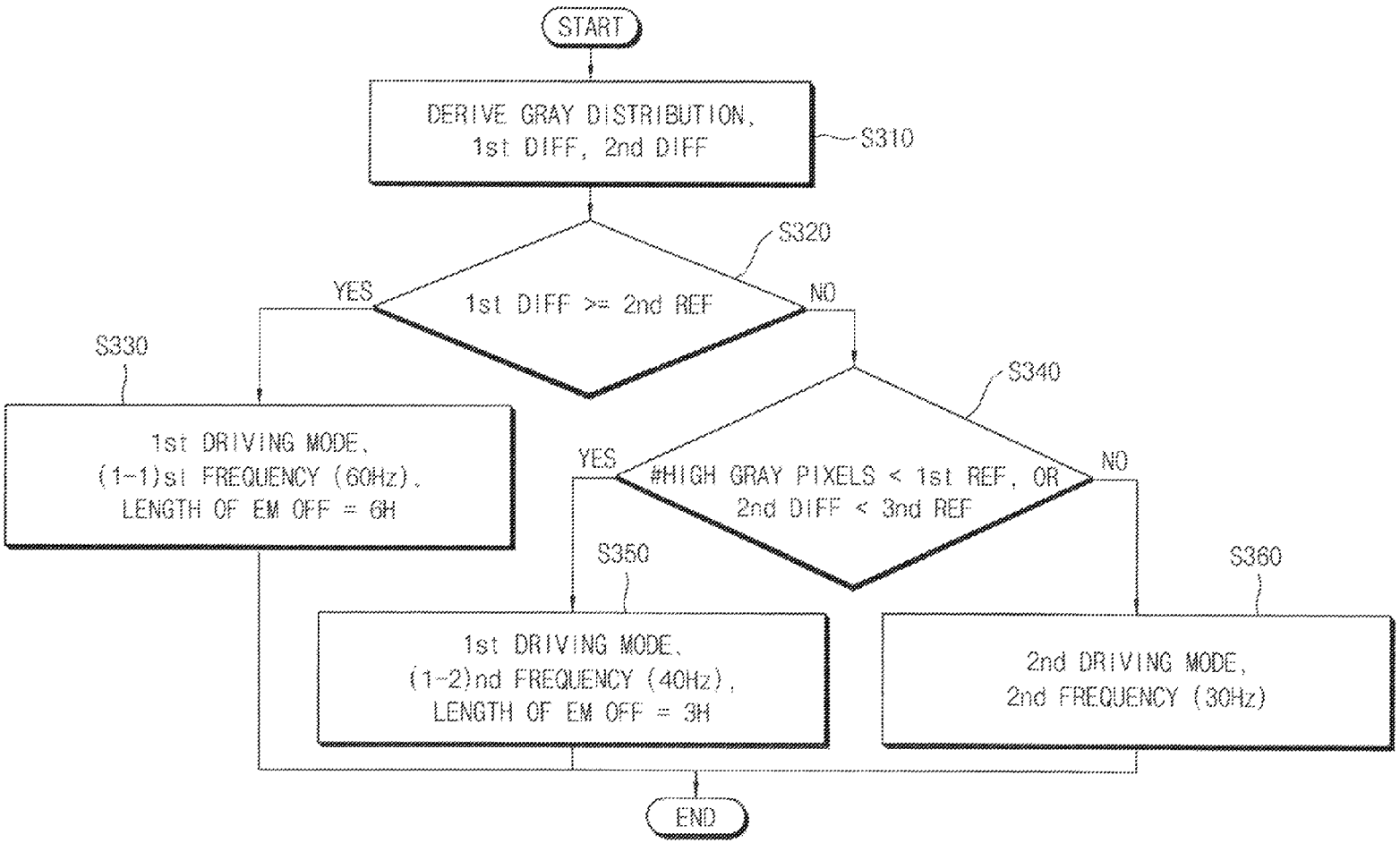

FIGS. 4A through 4C are flow charts illustrating that methods of determining a panel driving mode and a driving frequency by a controller of FIG. 3.

Referring FIGS. 4A through 4C, the controller may determine the panel driving mode and the driving frequency based on at least one selected from the grayscale distribution, the first difference value, and the second difference value.

As shown in FIG. 4A, the controller may determine the panel driving mode and the driving frequency by comparing a reference value with one of the grayscale distribution, the first difference value, and the second difference value.

The image data analyzer may derive at least one of the grayscale distribution of the input image data DATA, the first difference value DV1 between image data of a current frame and image data of a previous frame, and the second difference value DV2 between image data of adjacent pixels (5110). The driving determiner may compare the reference value with one of the number of high grayscale pixels derived from the grayscale distribution, the first difference value DV1, and the second difference value DV2 (S120). For example, when the number of high grayscale pixels is lesser than the first reference value, or the first difference value is greater than or equal to the second reference value, or the second difference value is lesser than the third reference value, the first driving mode in which the threshold voltage of the driving transistor is compensated may be selected as the panel driving mode and the driving frequency may be set to the first frequency that is relatively high (e.g., 60 Hz) to prevent the degradation of the display quality (5130). On the other hand, when the number of high grayscale pixels is greater than or equal to the first reference value, or the first difference value is lesser than the second reference value, or the second difference value is greater than or equal to the third reference value, the second driving mode in which the threshold voltage of the driving transistor is not compensated and the pixels are driven without the emission off-period may be selected as the panel driving mode and the driving frequency may be set to the second frequency that is relatively low (e.g., 30 Hz) to prevent the flicker and reduce the power consumption (S140).

As shown in FIG. 4B, the controller may determine the panel driving mode and the driving frequency by sequentially comparing reference values with at least two of the grayscale distribution, the first difference value, and the second difference value.

The image data analyzer may derive at least one selected from the grayscale distribution GD of the input image data DATA, the first difference value DV1 between image data of a current frame and image data of a previous frame, and the second difference value DV2 between image data of adjacent pixels (S210). The driving determiner may compare the second reference value with the first difference value DV1 (S220). When the amount of change of image data between the current frame and the previous frame is relatively large (e.g., a moving image), the first driving mode may be selected as the panel driving mode and the driving frequency may be set to the first frequency that is relatively high (e.g., 60 Hz) to prevent the degradation of the display quality (S230). When the amount of change of image data between the current frame and the previous frame is relatively small, the driving determiner may compare the reference values with the number of high grayscale pixels derived from the grayscale distribution or the second difference value DV2 (S240). When the number of high grayscale pixels is lesser than the first reference value, or the second difference value is lesser than the third reference value, the first driving mode may be selected as the panel driving mode and the driving frequency may be set to the first frequency to prevent the degradation of the display quality (S230). On the other hand, when the number of high grayscale pixels is greater than or equal to the first reference value, and the second difference value is greater than or equal to the third reference value, the second driving mode may be selected as the panel driving mode and the driving frequency may be set to the second frequency that is relatively low (e.g., 30 Hz) to prevent the flicker and reduce the power consumption (S250).

As shown in FIG. 4C, the controller may determine the panel driving mode, the driving frequency, and the length the off-period of the emission control signal by sequentially comparing reference values with at least two of the grayscale distribution, the first difference value, and the second difference value.

The image data analyzer may derive at least one of the grayscale distribution GD of the input image data DATA, the first difference value DV1 between image data of a current frame and image data of a previous frame, and the second difference value DV2 between image data of adjacent pixels (S310). The driving determiner may compare the second reference value with the first difference value DV1 (S320). When the amount of change of image data between the current frame and the previous frame is relatively large (e.g., a moving image), the first driving mode may be selected as the panel driving mode and the driving frequency may be set to the (1-1)st frequency (e.g., 60 Hz) and the length the off-period of the emission control signal may be set to the first length (e.g., 6 horizontal periods; 6H) to prevent the degradation of the display quality (S330). When the amount of change of image data between the current frame and the previous frame is relatively small, the driving determiner may compare the reference values with the number of high grayscale pixels derived from the grayscale distribution or the second difference value DV2 (S340). When the number of high grayscale pixels is lesser than the first reference value, or the second difference value DV2 is lesser than the third reference value, the first driving mode may be selected as the panel driving mode and the driving frequency may be set to the (1-2)nd frequency (e.g., 40 Hz) smaller than the (1-1)st frequency, and the length the off-period of the emission control signal may be set to the second length (e.g., 3 horizontal periods; 3H) to prevent the degradation of the display quality (S350). On the other hand, when the number of high grayscale pixels is greater than or equal to the first reference value, and the second difference value is greater than or equal to the third reference value, the second driving mode may be selected as the panel driving mode and the driving frequency may be set to the second frequency that is relatively low (e.g., 30 Hz) to prevent the flicker and reduce the power consumption (S360).

Figure 5:
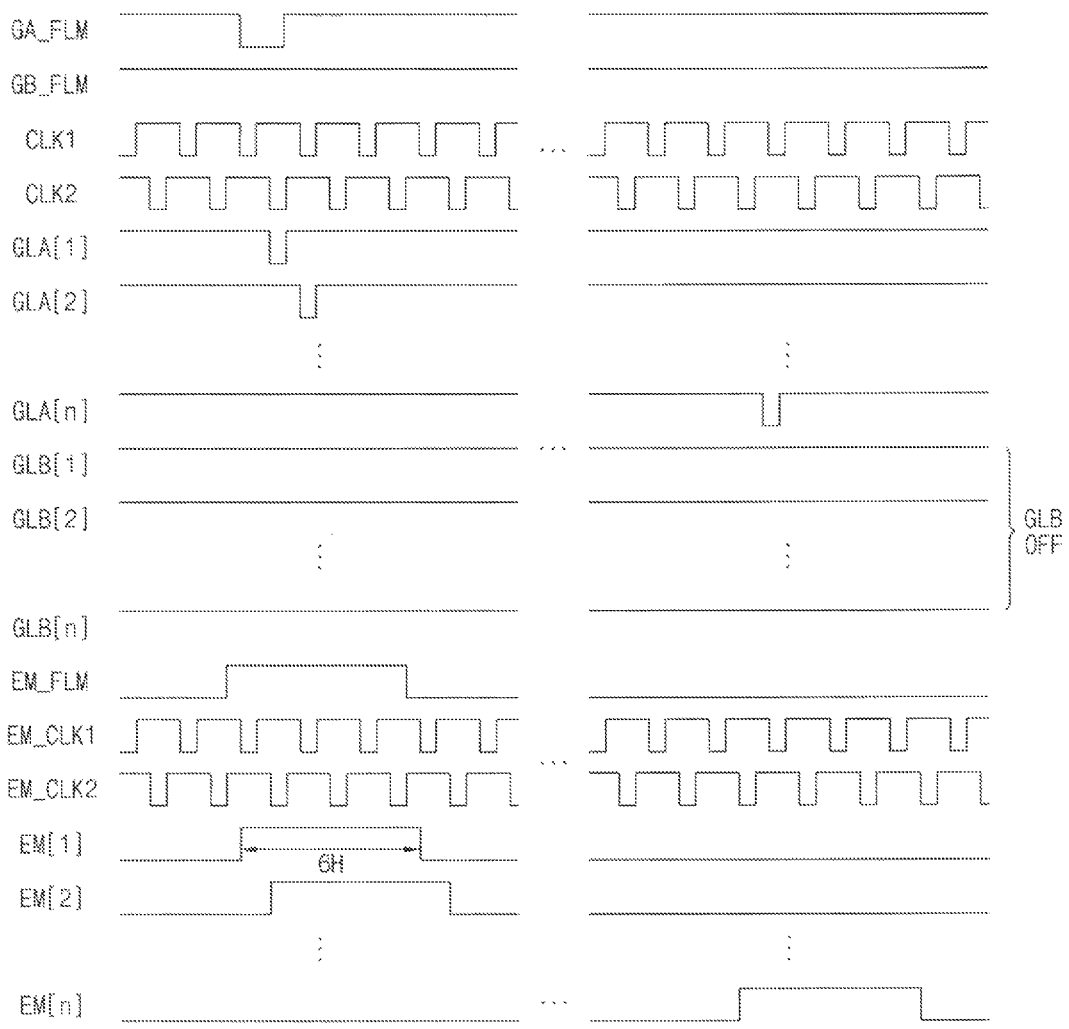
FIGS. 5 and 6 are diagrams for describing an operation of a pixel of FIG. 2 in a first driving mode.
Figure 6:
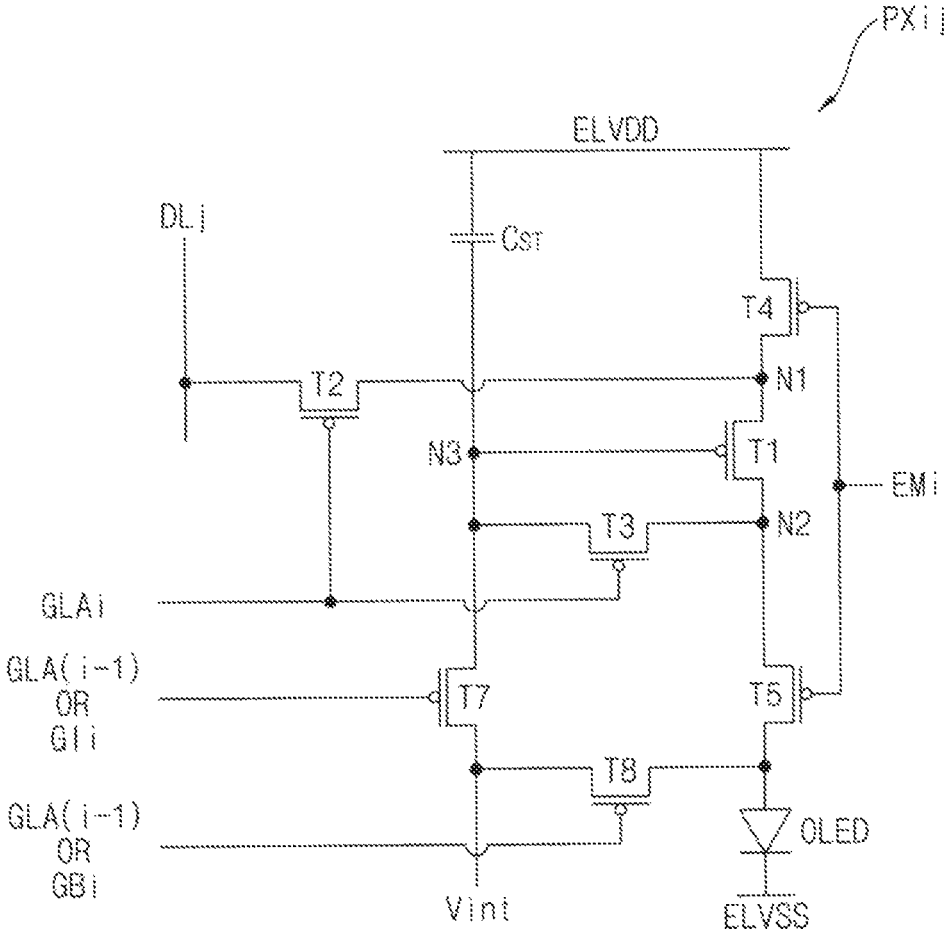

FIGS. 5 and 6 are diagrams for describing an operation of a pixel of FIG. 2 in a first driving mode.

Referring FIGS. 5 and 6, the pixel may be driven by the normal gate signal in a first driving mode in which a threshold voltage of a first transistor is compensated.

As shown in FIG. 5, in the first driving mode, a normal gate start signal GA_FLM may be provided, and then the normal gate signals GLA[1] through GLA[n] may be sequentially outputted from the normal stages. On the other hand, because an alternative gate start signal GB_FLM is not provided in the first driving mode, the alternative gate signals GLB[1] through GLB[n] may be not outputted from the alternative stages in the first driving mode. Also, because the first driving mode includes an initialization period, a data writing period and a threshold voltage compensating period for compensating the threshold voltage of the driving transistor, an emission control start signal EM_FLM may have off-period and the emission control signals EM[1] through EM[n] sequentially outputted from emission control stages may have off-period in the first driving mode. For example, each length of off-period of the emission control signals EM[1] through EM[n] may correspond to 6 horizontal periods (6H).

As shown in FIG. 6, because the alternative gate signal is not applied to the pixel in the first driving mode, the pixel PXij may be driven like as a pixel including 7 transistors (i.e., T1 through T5, T7, and T8) excluding the sixth transistor T6 and one capacitor Cst in the first driving mode.

Figure 7:
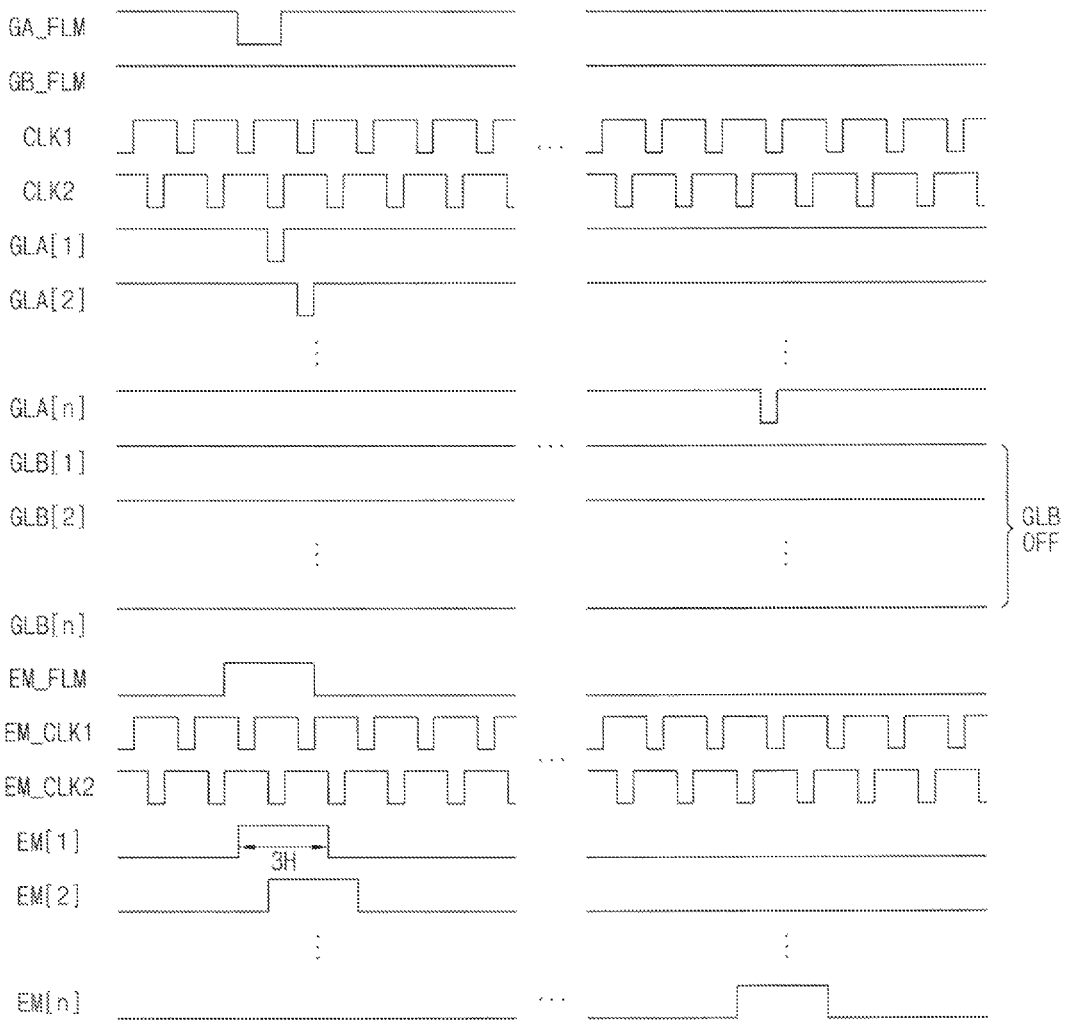
FIG. 7 is a waveform illustrating an example that a length of off-period of an emission control signal is adjusted in a first driving mode.

FIG. 7 is a waveform illustrating an example that a length of off-period of an emission control signal is adjusted in a first driving mode.

Referring FIG. 7, the length of the off-period of the emission control signal may be adjusted based on at least one selected from a grayscale distribution, a first difference value, and a second difference value. For example, to prevent the flicker that occurs by the emission off-period of pixels in low frequency driving mode, the length of the off-period of the emission control signal may be set to 3 horizontal periods (3H) that is shorter in comparison with the case of a normal frequency driving mode.

Figure 8:
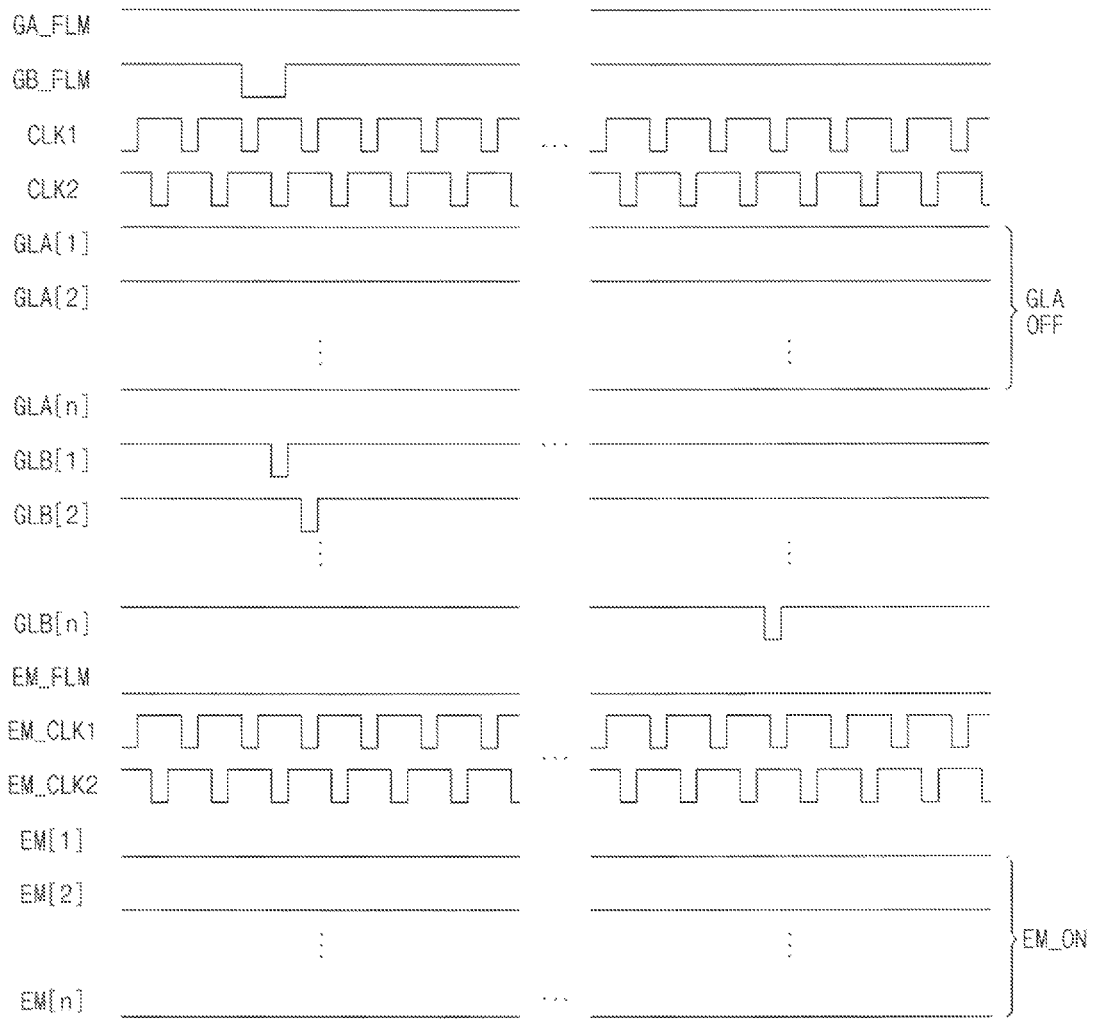
FIGS. 8 and 9 is a diagram for describing an operation of a pixel of FIG. 2 in a second driving mode.
Figure 9:
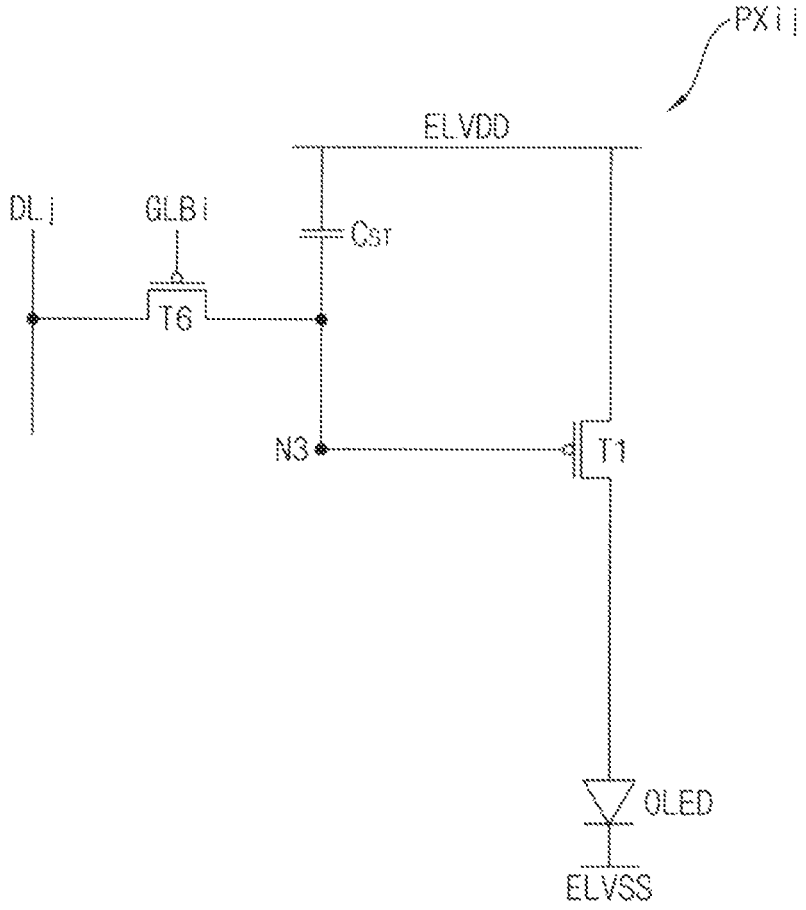

FIGS. 8 and 9 is a diagram for describing an operation of a pixel of FIG. 2 in a second driving mode.

Referring FIGS. 8 and 9, the pixel may be driven by the alternative gate signal in the second driving mode in which the threshold voltage of the driving transistor is not compensated and the pixels are driven without the emission off-period.

As shown in FIG. 8, in the second driving mode, an alternative gate start signal GB_FLM may be provided, and then the alternative gate signals GLB[1] through GLB[n] may be sequentially outputted from the alternative stages. On the other hand, because a normal gate start signal GA_FLM is not provided in the second driving mode, the normal gate signals GLA[1] through GLA[n] may be not outputted from normal stages in the second driving mode. Also, an emission control start signal EM_FLM may maintain the on-level during the second driving mode. Accordingly, the emission control signals EM[1] through EM[n] may maintain the on-level during the second driving mode.

As shown in FIG. 9, because the normal gate signals are not applied to the pixel PXij in the second driving mode and the emission control signals maintain the on-level during the second driving mode, the pixel PXij may be driven like as a pixel including 2 transistors (i.e., T1 and T6) and one capacitor Cst in the second driving mode.

Although the example embodiments describe that the organic light emitting display device includes the gate driver providing the normal gate signal and the alternative gate signal, it is not limited thereto. For example, the organic light emitting display device includes a first gate driver providing the normal gate signal and a second gate driver providing the alternative gate signal.

The present inventive concept may be applied to an electronic device having the organic light emitting display device. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An organic light emitting display device comprising:

a display panel including and a plurality of pixels;

a gate driver configured to provide a normal gate signal and an alternative gate signal to the pixels;

a data driver configured to provide a data signal to the pixels;

an emission control driver configured to provide an emission control signal to the pixels; and a controller configured to control the gate driver, the data driver, and the emission control driver, wherein each of the pixels is driven by the normal gate signal in a first driving mode in which a threshold voltage of a first transistor is compensated and is driven by the alternative gate signal in a second driving mode in which the threshold voltage of the first transistor is not compensated.

2. The display device of claim 1, wherein each of the pixels includes:

an organic light emitting diode;

a first transistor including a first electrode connected to a first node, a second node connected to a second node, and a gate electrode connected to a third node;

a second transistor including a first electrode receiving the data signal, a second electrode connected to the first node, and a gate electrode receiving the normal gate signal;

a third transistor including a first electrode connected to the second node, a second electrode connected to the third node, and a gate electrode receiving the normal gate signal;

a fourth transistor including a first electrode connected to a first power source, a second electrode connected to the first node, and a gate electrode receiving the emission control signal;

a fifth transistor including a first electrode connected to the second node, a second electrode connected to a first electrode of the organic light emitting diode, and a gate electrode receiving the emission control signal;

a sixth transistor including a first electrode receiving the data signal, a second electrode connected to the third node, and a gate electrode receiving the alternative gate signal; and a capacitor including a first electrode connected to the third node and a second electrode connected to the first power source.

3. The display device of claim 2, wherein each of the pixels further includes:

a seventh transistor including a first electrode connected to an initialization power source, a second electrode connected to the third node, and a gate electrode receiving a first initialization gate signal.

4. The display device of claim 3, wherein each of the pixels further includes:

an eighth transistor including a first electrode connected to the initialization power source, a second electrode connected to the first electrode of the organic light emitting diode, and a gate electrode receiving a second initialization gate signal.

5. The display device of claim 4, wherein the first initialization gate signal is substantially the same as the second initialization gate signal, and wherein the normal gate signal and the first initialization gate signal are applied to each of the pixels with an interval of one horizontal period.

6. The display device of claim 1, wherein the controller includes:

an image data analyzer configured to derive at least one selected from a grayscale distribution of image data, a first difference value between image data of a current frame and image data of a previous frame, and a second difference value between image data of adjacent pixels;

a driving determiner configured to determine a panel driving mode and a driving frequency based on at least one selected from the grayscale distribution, the first difference value, and the second difference value; and a control signal controller configured to generate a control signal for controlling the gate driver, the data driver, and the emission control driver based on the panel driving mode and the driving frequency.

7. The display device of claim 6, wherein the driving determiner includes:

a driving mode selector configured to select the first driving mode or the second driving mode as the panel driving mode based on at least one selected from the grayscale distribution, the first difference value, and the second difference value; and a driving frequency determiner configured to determine the driving frequency based on at least one selected from the grayscale distribution, the first difference value, and the second difference value.

8. The display device of claim 7, wherein the driving mode selector derives a first number of pixels each of which grayscale is higher than or equal to a reference grayscale from the grayscale distribution, selects the first driving mode as the panel driving mode when the first number is lower than a first reference value, and selects the second driving mode as the panel driving mode when the first number is higher than or equal to the first reference value.

9. The display device of claim 7, wherein the driving frequency determiner derives a first number of pixels each of which grayscale is higher than or equal to a reference grayscale from the grayscale distribution, set the driving frequency to a first frequency when the first number is lower than a first reference value, and set the driving frequency to a second frequency lower than the first frequency when the first number is higher than or equal to the first reference value.

10. The display device of claim 7, wherein the driving mode selector selects the first driving mode as the panel driving mode when the first difference is higher than or equal to a second reference value and selects the second driving mode as the panel driving mode when the first difference is lower than the second reference value.

11. The display device of claim 7, wherein the driving frequency determiner set the driving frequency to a first frequency when the first difference is higher than or equal to a second reference value and set the driving frequency to a second frequency lower than the first frequency when the first difference is lower than the second reference value.

12. The display device of claim 7, wherein the driving mode selector selects the first driving mode as the panel driving mode when the second difference is lower than a third reference value and selects the second driving mode as the panel driving mode when the second difference is higher than or equal to the third reference value.

13. The display device of claim 7, wherein the driving frequency determiner set the driving frequency to a first frequency when the second difference is lower than a third reference value and set the driving frequency to a second frequency lower than the first frequency when the second difference is higher than or equal to the third reference value.

14. The display device of claim 7, wherein the driving determiner further includes:

an emission controller configured to adjust a length of an off-period of the emission control signal based on at least one selected from the grayscale distribution, the first difference value, and the second difference value.

15. The display device of claim 6, wherein the control signal generator generates the control signal such that the normal gate signal is sequentially outputted to a plurality of normal gate lines when the panel driving mode is the first driving mode, and generates the control signal such that the alternative gate signal is sequentially outputted to a plurality of alternative gate lines when the panel driving mode is the second driving mode.

16. The display device of claim 6, wherein the control signal generator generates the control signal such that the emission control signal is an off-level in at least a portion of the first driving mode, and generates the control signal such that the emission control signal maintains an on-level during the second driving mode.

17. A pixel comprising:

an organic light emitting diode;

a first transistor including a first electrode connected to a first node, a second node connected to a second node, and a gate electrode connected to a third node;

a second transistor including a first electrode receiving a data signal, a second electrode connected to the first node, and a gate electrode receiving a normal gate signal;

a third transistor including a first electrode connected to the second node, a second electrode connected to the third node, and a gate electrode receiving the normal gate signal;

a fourth transistor including a first electrode connected to a first power source, a second electrode connected to the first node, and a gate electrode receiving an emission control signal;

a fifth transistor including a first electrode connected to the second node, a second electrode connected to a first electrode of the organic light emitting diode, and a gate electrode receiving the emission control signal;

a sixth transistor including a first electrode receiving the data signal, a second electrode connected to the third node, and a gate electrode receiving an alternative gate signal; and a capacitor including a first electrode connected to the third node and a second electrode connected to the first power source.

18. The pixel of claim 17, further comprising:

a seventh transistor including a first electrode connected to an initialization power source, a second electrode connected to the third node, and a gate electrode receiving a first initialization gate signal.

19. The pixel of claim 18, further comprising:

an eighth transistor including a first electrode connected to the initialization power source, a second electrode connected to the first electrode of the organic light emitting diode, and a gate electrode receiving a second initialization gate signal.

20. The pixel of claim 19, wherein the first initialization gate signal is substantially the same as the second initialization gate signal, and wherein the normal gate signal and the first initialization gate signal are applied with an interval of one horizontal period.

* * * * *